US005386281A

United States Patent [19]

Mitani et al.

[11] Patent Number: 5,386,281

[45] Date of Patent: Jan. 31, 1995

[54] THERMAL FIXING DEVICE

[75] Inventors: Masao Mitani; Kazuo Shimizu, both of Ibaraki, Japan

[73] Assignee: Hitachi Koki Co., Ltd., Tokyo, Japan

[21] Appl. No.: 64,805

[22] Filed: May 21, 1993

[30] Foreign Application Priority Data

Jun. 5, 1992 [JP] Japan ..... 4-145868

[51] Int. Cl.[6] ..... G03G 15/20

[52] U.S. Cl. ..... 355/290; 355/295

[58] Field of Search ..... 355/285, 290, 295

[56] References Cited

U.S. PATENT DOCUMENTS

| | | | |
|---|---|---|---|
| 4,959,693 | 9/1990 | Mitsuya et al. | 355/290 |
| 5,051,784 | 9/1991 | Yamamoto et al. | 355/285 |
| 5,091,752 | 2/1992 | Okada | 355/285 |
| 5,099,288 | 3/1992 | Britto et al. | 355/290 |
| 5,149,941 | 9/1992 | Hirabayashi et al. | 355/290 X |
| 5,196,675 | 3/1993 | Suzuki et al. | 355/285 X |
| 5,262,834 | 11/1993 | Kusaka et al. | 355/285 |
| 5,278,618 | 1/1994 | Mitani et al. | 355/285 |

FOREIGN PATENT DOCUMENTS

| | | |
|---|---|---|
| 4166966 | 6/1992 | Japan . |
| 4284481 | 10/1992 | Japan . |
| 4362983 | 12/1992 | Japan . |

*Primary Examiner*—Fred L. Braun

*Attorney, Agent, or Firm*—Sughrue, Mion, Zinn, Macpeak & Seas

[57] ABSTRACT

A thermal fixing device including a pair of rotating rollers which are press-contacted to each other, a heating section associated with at least one of the rollers and an image supporter having an unfixed toner image which is passed through a gap between the rollers so that the unfixed toner image is thermally (melt) fixed, the heating section having an integral structure type heating and cooling device which includes a cooler and a heater acting as a support, and wherein the fixing device further includes a thin endless metal belt which rotates while contacting the integral structure type device and which has a non-adhesive film on the outer surface of the belt, and a drive roller which drives the endless metal belt for rotation while applying tension to the endless metal belt. The surface temperature at a portion where the endless metal belt is in pressure-contact with the image supporter is first increased to a temperature (Tm) near the melting point of the toner and then cooled so that the image supporter can be stripped prior to the endless metal belt, and so that the temperature is higher than the glass transition point of the toner and lower than the softening point of the toner.

7 Claims, 7 Drawing Sheets $0 < \alpha, \beta \lesssim 10°C$

Tm : MELTING POINT OF TONER

Ts : SOFTENING POINT OF TONER

Tg : GLASS TRANSITION POINT OF TONER $T_A$ : $T_s \sim T_m$ $T_B$ : $T_g \sim T_s$ $T_C$ : $T_B \sim \alpha$ $T_D$ : $T_C \sim \beta$ $T_E$ : $T_g \sim T_s$

THERMAL FIXING DEVICE

BACKGROUND OF THE INVENTION

The present invention relates to a thermal fixing device which is used in an image forming device for electrophotography.

DESCRIPTION OF THE RELATED ART

Thermal fixing devices of the pressing type, heat roller type, etc. are commonly used in electrophotography recording devices. The main type of thermal fixing device over the past ten to twenty years has been a heat roller type. However, this type has a problem in that the time which is required for starting the operation, i.e., the temperature rising time till the fixing time, is long and the dissipation power is large. This problem negatively affects the entire performance of the electrophotography recording device.

A fixing device such as a SURF type is one example in which the above problem was drastically improved. This device has been adopted by Canon Co. Ltd. since Feb. 2, 1990. In this fixing device, the temperature rising time is remarkably shortened to about 5 seconds, and the dissipation power is successfully reduced to about half. However, even this type of device has problems such that the life of the device is short and the device has a large number of parts.

The present inventors have invented a type of device using a metal belt in which the problems of this SURF type fixing device are drastically solved, and they have filed patent applications (Patent publication (Kokai) Nos. 4-166966, 4362983 and 4-284481) for this invention.

The first feature of the inventor's fixing device is an endless metal belt. The result of using such a belt is that the heat generated by the heater can be efficiently and quickly conducted to the unfixedtoner on the recording paper. This enabled the temperature of the heater to be lowered significantly, and the thermal efficiency to be improved. Consequently, the dissipation power is significantly reduced.

The quick and efficient thermal conduction enabled rapid cooling of the toner after melting of the toner, and the toner offset phenomenon could be drastically improved in dry fixing by using a monolithic structure small type heating and cooling device. This is the second feature of the inventor's fixing device.

The third feature is that a PTC heater element could be used for the heater. As is known, the PTC heater element has limited heating ability due to it's own low thermal conductivity and has not been actually used in a thermal fixing device which requires large calorific value.

However, the fixing device invented by the present inventors combines low dissipation power with high thermal conduction, and thus enables use of a low heat capacity PTC heater. Thus, in the fixing device, the PTC heater element can be utilized. According to the tests in a laboratory, a fixing speed of 25 sheets (A4)/minute can be realized. The PTC heater includes a thermometer and a controlled source but does not include many parts which have been indispensable to the conventional thermal fixing device.

The fourth feature is that the adhesion property between the metal belt and a fluorine resin layer covered on the surface of the metal belt is sufficiently strong. One of the reasons for the short life of said SURF fixing device is derived from the fact that the fluorine resin covered on the surface of the endless belt made of polyimide resin is removed during use.

The fixing device of the present invention has many other superior features such as, for example, thermal fixing envelopes without wrinkles.

The above-mentioned fixing device eliminates problems associated with the fixing property such as the fixing strength and the presence and absence of offset with respect to monochrome recording using, for example, a black toner. Elimination of these problems is made in dry fixing in which silicone oil is not applied and it is the valuation (experimentation) results for various black toners.

A successful example of such dry fixing is a SURF type fixing device which has been mounted on the PC-1 and PC-2 sold by Canon Co. Ltd. beginning in February of 1990. The SURF fixing device is the first actual product. The black toner adopted in this device was developed for this SURF type fixing device, and the toner was designed so that even with temperatures near the melting point of the toner, the toner has sufficient viscosity, and during fixing, the generation of offset is prevented.

When color toner image is dry-fixed using the fixing device described above, the problem of offset still occurs. This problem occurs due to the fact that the adhesion force between the color toner and the non-adhesive cover layer of polytetrafluoro-ethylene (PTFE) etc. is relatively large, and the dynamic shearing elastic modulus of the toner is low even with temperatures near the toner glass transition point, such that offset occurs.

SUMMARY OF THE INVENTION

An object of the present invention is to solve the disadvantages of the conventional technique and to provide a thermal fixing device in which offset of the color toner is significantly reduced, dry fixing can be carried out, dissipation power is low, and warming up time is reduced.

According to the present invention, there is provided a thermal fixing device wherein a pair of rollers rotates while being press-contacted to each other, a heating section is provided in at least one of the rollers, and an image supporter having unfixed toner images is passed through a gap between the rollers so that the unfixed toner image is thermally melt fixed. The roller in which the heating section is provided has an integral structure type heating and cooling device consisting of a cooler and a heater acting as a supporter. A thin endless metal belt rotates while contacting the integral structure type device and has a non-adhesive film on the outer side surface. A drive roller drives the endless metal belt for rotation while applying tension to the endless metal belt. The surface temperature at a portion where said endless metal belt is in press-contact with the image supporter is first increased to a temperature (Tm) near the melting point of said toner and then cooled so that the temperature of the portion where the image supporter is removed from the endless metal belt is higher than the glass transition point of the toner and lower than the softening point.

The principle of the present invention is that after the toner transferred on the image supporter is sufficiently heat-fixed, it is cooled to within a predetermined temperature range and peeled off from the metal belt. Consequently, the application of silicone oil, which is required in all conventional heat roll type fixing devices, is not needed in the present invention, and the amount of toner offset is remarkably reduced, even for dry fixing. The evaluation method for the offset and the experiment results thereof will be described below.

FIG. 8(*a*) is an explanatory view of a conventional non-offset evaluation method. A metal plate 101 is uniformly heated and covered by a non-adhesive film layer 100 such as, for example, a 10 micrometer thick PTFE (polytetrafluoroethyren) layer. A heater is denoted by reference numeral 102, and the toner transferred recording paper (image supporter) is denoted by reference numeral 103. A weight is applied to the recording paper by putting a heat insulating weight on the paper, for example, a metal block on silicone rubber, so that the toner is sufficiently heat-fixed. The reference numeral 104 denotes a thermocouple.

Although the heating condition depends on the heat capacitance of the uniformly heated plate 101 and the characteristic value of the toner, in this case, heating was carried out at 140 degrees for 30 seconds and the fixing ratio was 95% or more, even in the tape peeling test. It was also confirmed that overheating has no influence on the results of the non-offset evaluation.

As shown in the FIG. 8(*b*), the weight (metal block 105) on the heater 102 is removed and, after natural cooling, the recording paper 103 is peeled off at a constant speed (see FIG. 8(*c*). The temperature of the non-adhesive film is defined as a peeling temperature, and the force which is required for the peeling is defined as a peeling strength. The evaluation is carried out at a peeling speed of about 40 mm/sec in this case. Thus, since the desired speed of the fixing device is a copy speed of only 6 to 7 sheets (A4)/minute, satisfactory results can be obtained at even two to three times the desired speed. With respect to the weight used during thermal fixing, the evaluation was carried out using 30 to 300 g/cm2. Nevertheless, the evaluation results do not vary. In the present example, a typical weight of 100 g/cm2 was used.

FIG. 3 shows experimental results in which a red toner (magenta) having the greatest offset in color toner and a black toner having the least offset are used, and wherein PTFE and silicone rubber are selected as the non-adhesive film materials for the evaluation objects.

It was found that, in a combination of the black toner and PTFE (curve A in FIG. 3), the peeling strength is decreased at a peeling temperature of 800 degrees or less and at the same time the offset does not occur completely. On the other hand, it was also found that, in a combination of the magenta and PTFE (curve B in FIG. 3), the peeling speed is very high and, if the peeling temperature is lowered, the peeling strength is reduced linearly. Curve C in Pig. 3 shows a combination of magenta and silicone. FIG. 4 shows results in which the non-offset properties for the combination of the magenta and the PTFE and the combination of the magenta and the silicone were evaluated. In this case, the amount of offset is shown by values obtained when the offset toner remaining on the non-adhesive film is refixed to a white paper and the measured value (0.55) for the reflection concentration of the white paper is subtracted from the measured value for the reflection concentration. As can be understood from the results of the combination of the magenta and the PTFE (curve B), the amount of offset is rapidly decreased at a peeling temperature of 90 degrees or less. Nevertheless, it was found that offset still occurs.

The combination in which a very large difference from this result could be found is that of the color toner and the silicone (curve C). When the peeling strength for the black toner and the magenta toner approaches zero (5 g/2 cm or less of the resolving power of the measuring device) and the peeling temperature of the black toner is 100 degrees or less, the offset was negligibly small. With respect to the magenta, it was found that the offset does not occur at all at a peeling temperature of 100 degrees or less.

At a peeling temperature of 50 to 60 degrees, the offset is likely to be increased a little. It was determined that this tendency clearly relates to the glass transition point of a base resin which is a main component of the toner. Further, the fact that the amount of offset is rapidly decreased at a peeling temperature of about 100 degrees relates to a softening point of the toner. Thus, the range of the most suitable peeling temperature is higher than the glass transition point of the object toner and lower than the softening point.

According to the present invention, the peeling temperature can be set in a range of comparatively high temperatures, and the metal belt temperature can be returned to within a heating region without decreasing the metal temperature. Accordingly, lost calories can be remarkably reduced. At the same time, the temperature difference in the heating and the cooling region for the metal belt can be remarkably reduced.

DESCRIPTION OF PREFERRED EMBODIMENTS

Embodiments of the present invention will be described below with reference to the drawings.

Embodiment 1

Figure 1:
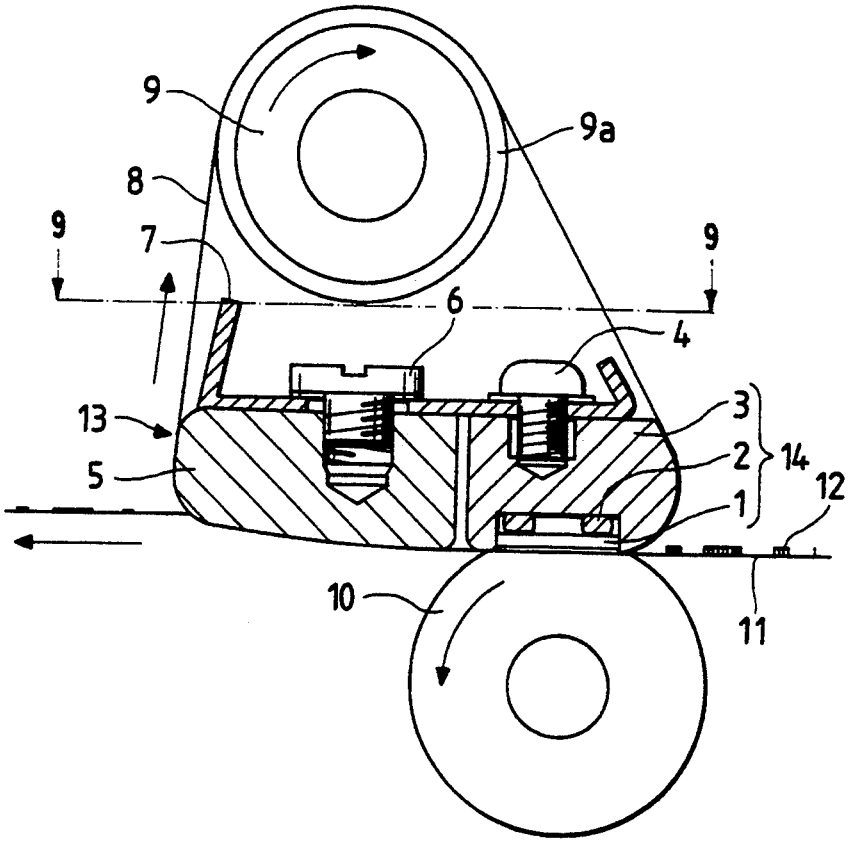
FIG. 1 is a cross-sectional view of a thermal fixing device according to one example of the present invention.
Figure 2:
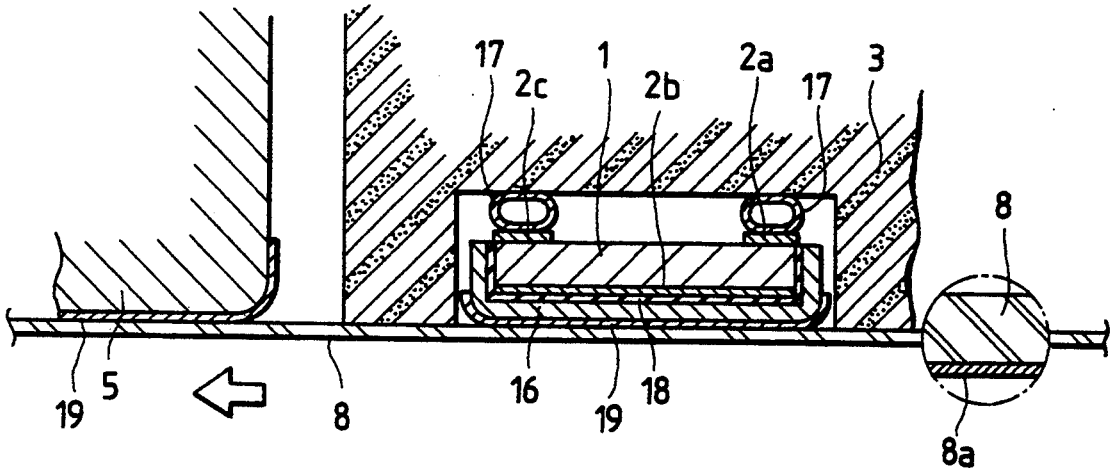
FIG. 2 is an enlarged view of a main portion of the thermal fixing device.
Figure 3:
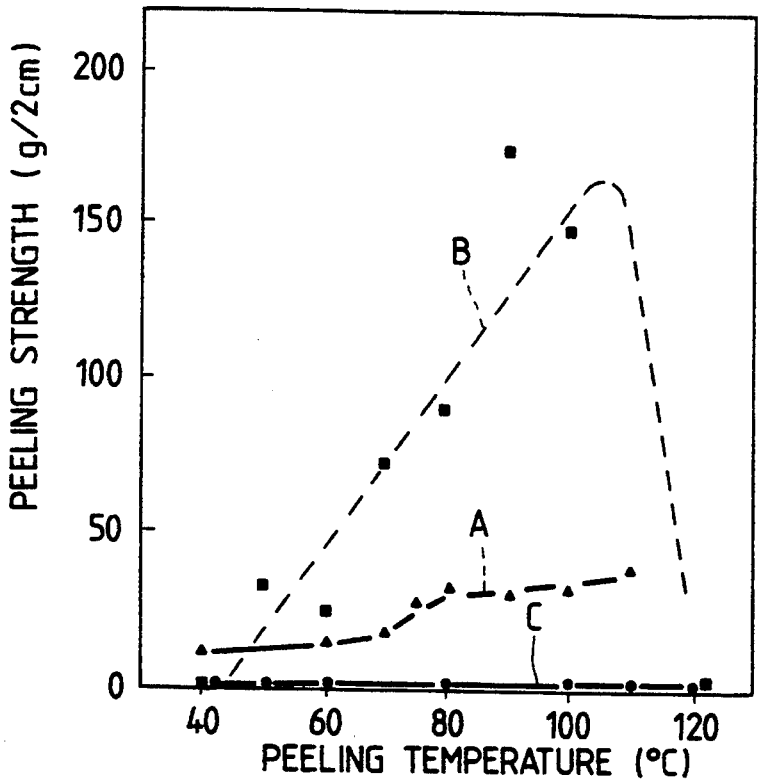
FIG. 3 is a graph showing a relationship between the peeling temperature and the peeling strength.
Figure 4:
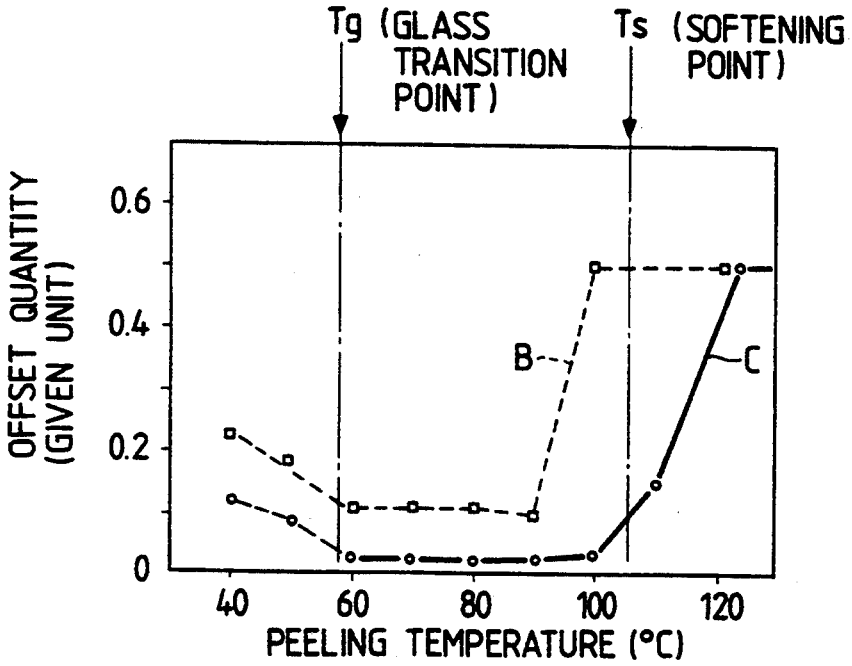
FIG. 4 is a graph showing a relationship between the peeling temperature and the amount of offset.

FIG. 1 is a cross-sectional view of a thermal fixing device according to one embodiment of the present invention, and FIG. 2 is an enlarged view of a main portion of the thermal fixing device. The thermal fixing device generally includes an integral structure type heating and cooling device 13, an endless metal belt 8 including an outer non-adhesive film 8*a* (see FIG. 2), a drive roller 9 which causes the endless metal belt 8 to rotate while being in tight contact with the integral structure type heating and cooling device 13', and a pressing roller 10 which is driven to rotate while being pressed on the integral structure type heating and cooling device 13 with a force of a few kilograms. While a recording paper 11 is supplied in a pressed state between the endless metal belt 8 and the pressing roller 10, unfixed toner 12 on the recording paper 11 is heated and melted by a PTC heater 1 through the endless metal belt 8 and the toner 12 is "fixed" into the recording paper 11. After that, the toner 12 is immediately cooled in a region of a cooler 5. Consequently, when the recording paper 11 is peeled off at a portion near the edge of the cooler 5, the viscosity of the toner is increased, and there is no offset on the endless metal belt 8.

A heater 14 generally includes leading electrodes 2*a*, 2*b* and 2*c* embedded in an insulator 3, a PTC heater element 1, a plate 16 to be uniformly heated, which plate 16 is made of an aluminum sheet covering the entire belt side surface of the PTC heater element 1, a spring shaped contact element 17 and an insulating sheet 18. The elements are assembled by using a heat resisting bond.

The insulator 3 is composed of, for example, a polyphenylensulfide (PPS) resin casting article and has properties similar to the metal belt 8, such as good heat resisting properties, low heat conducting properties, high electric insulating properties and good sliding properties.

The PTC heater element 1 is a positive characteristic thermistor in which the electric resistance is rapidly changed in a comparatively narrow temperature range as the temperature rises. The heater element 1 is formed from a univalent or trivalent metal oxide having a base of BaTiO3. In the present example, there are provided 11 chips which is 0.9 mm in thick, 8 mm in width, and 20 mm in length, and a leading electrode 2 is used as an electrode for electrical connection in parallel. In this case, the heater element is a heater for A4 size paper. Heaters for B4 and A3 size paper may be used by lengthening the heater element and increasing the number of chips in accordance with the length. To make the belt side surface of the PTC heater elements flat, a 300 micrometer thick plate 16 to be uniformly heated is fixed to the outer side surface of the PTC heater 1 with a heat resistant and highly conductive bond.

To maintain the sliding property of the metal belt 8, a solid lubricant having a small friction factor and the least amount of mutual abrasion is formed on the belt side surface of this plate 16 to be uniformly heated. As the solid lubricant 19, for example, molybdenumdisulfide or PTFE can be used, and the thickness of the film is preferably 15 to 20 micrometers.

The heater 14 is fixed to a support 7 by a screw 4.

Figure 9:
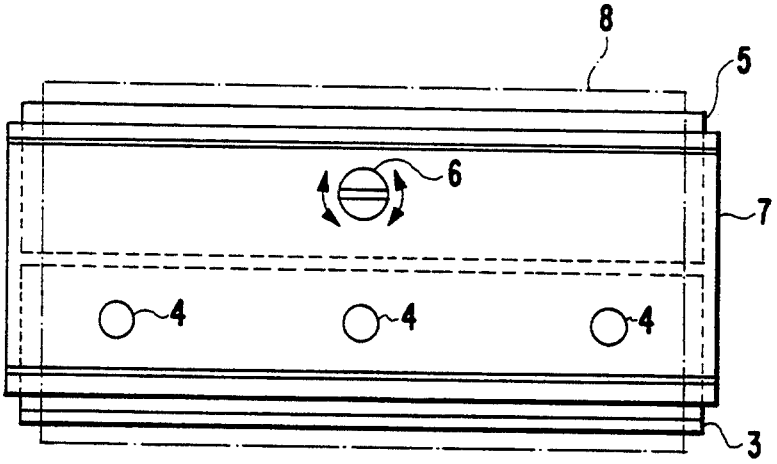
FIG. 9 is a sectional view taken along the line 9—9 in FIG. 1.

The cooler 5 is composed of an aluminum extrusion molding. The sliding surface for the metal belt 8 is covered with the same solid lubricant 19 as is mentioned above. As the curvature of the surface of the cooler 5 increases, the contact pressure of the metal belt 8 is decreased and the heat exchange ratio for the metal belt 8 is decreased. The selection of the curvature depends on the fixing rate etc. The shape of the cooler 5 is determined so that the surface temperature of the metal belt at a portion where the recording paper 11 is peeled off is set in the most suitable peeling temperature range. The edge portion of the cooler 5 has a small curvature in the manner that the recording paper 11 is easily peeled off from the metal belt 8. Thus, the contact pressure of this portion against the cooler 5 is increased. Even after the recording paper is separated from the metal belt 8, heat is radiated from the belt to the cooler, and heat loss occurs. Therefore, although not shown in FIG. 1, the edge portion of the cooler 5 is composed of an insulator having a good sliding property, for example, a PPS resin. The cooler 5 is fixed to the supporter 7 at a rotation axis 6 in the center portion (see FIG. 9). However, the cooler 5 has a space of about 0.5 mm from the heater 14 and is thermally separated from the heater 14. This contributes to a decrease in heat loss for the heater 14 and a decrease in a temperature rise rate of the cooler. Further, a back and forth (zigzag) movement of the cooler 5 due to the rotation of the endless metal belt 8 is controlled by a small rotation movement of the cooler 5.

The metal belt 8, after it leaves the cooler 5, rotates surely without sliding by using a rubber layer 9a covered on the surface of the drive roller 9. Heat is transferred from the belt 8 to the drive roller 9. If the amount of the thermal transfer is reduced, the heat quantity in the heater 14 is decreased, with the result that the dissipation power is also reduced. The temperature gradient of the metal belt 8 can be lessened, and the generation of wrinkles in the belt 8 can be prevented. To accomplish this, the thermal conductivity of the rubber layer 9a of the drive roller 9 to the inner side is decreased, and the temperature decrease of the metal belt 8, which is in tight contact with the drive roller 9, is reduced. The drive roller 9 is made of a stainless steel having the shape of a cylinder or a round tube with a diameter of 15 to 20 mm, the surface of the stainless steel being covered with natural or synthetic rubber layer with a thickness of 0.1 to 0.5 mm. The ratios of the heat capacity (specific heat×specific gravity) of the stainless steel and the rubber, and the ratios of the thermal conductivity, are 1:0.5, 1:0.01, respectively. Thus, if the thickness of the rubber layer 9a is increased, it acts as the insulating layer. However, from the viewpoint of rigidity, there are limits as to how thick the rubber layer 9*a* can be made.

In order to overcome these limitations, a drive roller in which an engineering plastic round tube or cylinder is covered with a rubber layer is used in the present example. Since the upper limit temperature of the metal belt 8 supplied to the drive roller 9 is made lower than the softening point of the toner used, a temperature lower than 100 degrees is generally used. Namely, as the rubber material and the engineering plastic material, various material can be selected in a wide range. The heat capacitance and the heat conductivity of the engineering plastic material are substantially the same as those of the rubber material. When the thus formed drive roller 9 is used, at ten seconds after starting operation of the fixing device shown in FIG. 1, the temperature decrease in the metal belt 8 due to the drive roller 9 can be limited to about 10 degrees. In a drive roller using a conventional type stainless steel as an axis center, the temperature decrease was 30 to 50 degrees. Thus, in the present invention, a decrease in the dissipation of heat of about 20% can be realized. Further, the temperature decrease in the present invention advantageously contributes to the prevention of generation of wrinkles in the belt 8. After 10 seconds after staring operation, the temperature decrease is made even smaller. The largest dissipation power is 350 W, which is less than ½ that of a conventional device.

The pressing roller 10 may be a soft roller having a very low strength when compared to the pressing roller which has been used in a conventional thermal fixing device. This is true since a very wide nip width for heating is needed to make the pressure of the pressing roller small and to make the sliding resistance between the heater 14 and the metal belt 8 small, as well as to reduce a necessary rotation torque. A pressing roller having a small diameter is also preferred for miniaturization, lightness and low cost.

Thus, a 20 to 25 mm diameter silicone foaming rubber soft roller having a molding skin layer on the surface was used while using the pressure of 1.5 to 2 kg. The hardness of the soft roller is 5 degrees or less at JIS-A scale (30 degrees at the ASKER-C scale) which is very low, while the hardness of the conventional pressure roller is 20 to 30 degrees or more at JIS-A scale with a pressure of 5 to 10 kg or more.

In the above embodiment of the present invention, the hardness of the rubber of the pressing roller used was evaluated by a condition of 15 degrees and 30 degrees in ASKER C scale (Japanese Rubber Association Standard), and the pressure was evaluated using a pressure of 1.5 to 2 kg. The nip width in these cases was 6 to 8 mm.

When the pressing roller having a small rubber hardness is pressurized during a non-operational period, the pressing roller is deformed and the restoration of the roller requires some time. Consequently, the pressure on the recording paper is changed, and the fixing is disadvantageously affected. In order to solve this problem, the electromagnetic solenoid was operated so as to press only during operational periods. In this process, if a jam of the recording paper occurs, the pressing roller is released, and the paper-drawing operation can be easily carried out. Thus, the process is effective in reducing the number of parts.

Figure 5:
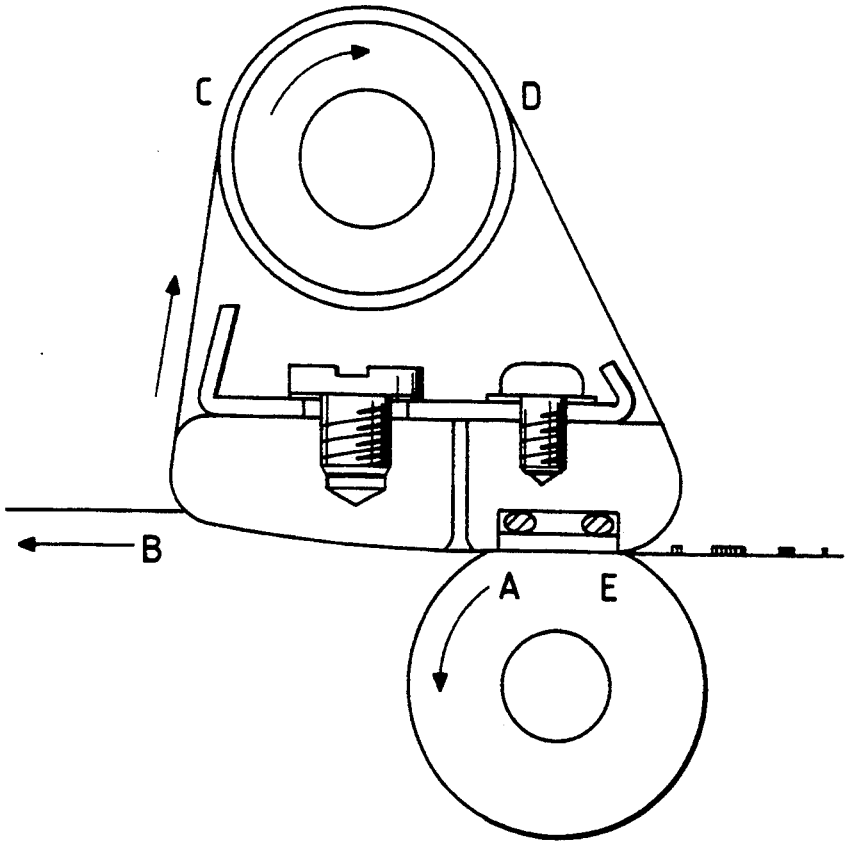
FIG. 5 is a cross-sectional view illustrating the temperature relationship between each portion of the thermal fixing device.

The surface temperature of the non-adhesive surface of the endless belt which is worked by the present fixing device and which is constructed as described above is distributed as shown in FIG. 5. This distribution is determined from evaluating results of the non-offset property described above, as well as various other considerations mentioned in the preceding description of the first embodiment.

It is preferable to employ a temperature such that the toner can be sufficiently fixed to the recording paper, near the point A, namely, the temperature may be advantageously increased to near the melting point of the toner. However, when the nip width (nip time) is very large, the temperature is not necessarily increased to the melting point as in the present fixing device. As will be mentioned hereinafter, even if the temperature is lowered, a sufficient fixing strength can nevertheless be obtained. Therefore, from the viewpoint of dissipation power, and from the viewpoint that the maximum temperature of the present fixing device is lowered significantly to increase the factor of safety, a temperature of TA, i.e., the curie point of the PTC heater device 1 which is used can be determined. In this case, a TC of 190 degrees was used.

If the peeling temperature at the peeling point B is in a range higher than the transition point Tg of the toner glass and lower than the softening point Ts of the toner, the amount of the offset is minimized. When the fixing device of the present example is operated, the heat capacity of the cooler 5 (relating to the amount of the emitted heat) is designed such that $T_B \leqq 65$ degrees at 10 seconds after the start of the operation, and $T_B \leqq 90$ degrees after the continuous fixing of a plurality of sheets (e.g., 40–70). Further, in the case where a design for a continuous use for a long time is intended, the temperature conditions can be easily satisfied by enlarging the cooler 5 and providing a small heat sink fin.

The temperature at the introduction point C to the drive roller 9 is lowered by 7 to 8 degrees than $T_B$ by the heat conduction to the top portion of the cooler 5 and it is further lowered by the maximum 7 to 8 degrees at a point D by the heat conduction to the drive roller 9. The temperature TD having the range of $50 \leqq T_D \leqq 80$ degrees (10 seconds after the operation start) is shown. The value of $T_D$ is substantially kept in a region to the entrance portion of the heater 14 and the temperature of the point D is heated by the heat insulator 3 heated by the heat conduction so that the belt 8 is preheated to 80 to 90 degrees at the point E. After that, the belt 8 is pressed on the recording paper 11 at the point E.

The temperature of the surface of the recording paper, obtained when the recording paper was passed through the fixing device was measured by the following methods. Namely, a toner directly printed recording paper was provided with a portion of 13 micrometer diameter chromel-alumel thermocouple (other than the top 1 to 2 mm thereof) by Teflon tape with a bonding agent. The indicated values of the thermocouple, obtained when the recording paper was passed through the fixing device, were recorded by a recorder. This thermocouple is used to make numerous temperature measurements, the top portion of the thermocouple being embedded in the toner. Therefore, the indicated values show the toner temperature. One example of the change of the measured toner temperature is shown in FIG. 6.

Figure 6:
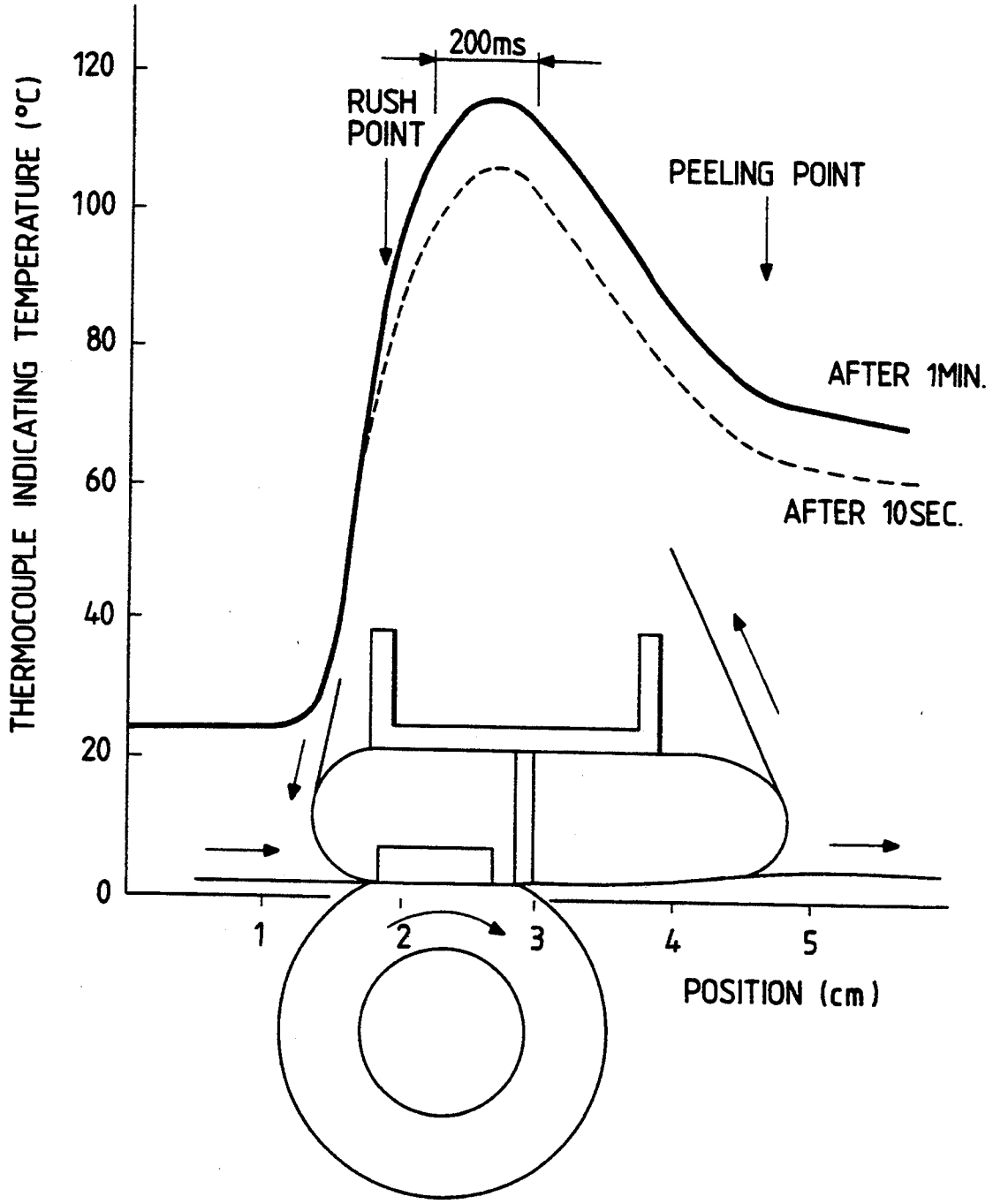
FIG. 6 is a combination graph/cross-sectional view indicating temperature characteristics of the thermal fixing device.

As can be understood from FIG. 6, a considerable temperature rise is due to the radiation heating. Nevertheless, this temperature rise is thought to be only in a region near the surface of the recording paper. Thus, even in heating in the direction of the thickness of the recording paper, which heating results from press contact, the maximum final temperature of the toner was only 105 degrees at 10 seconds after the start of heating and 115 degrees at 1 minute thereafter.

A thermal fixing through unfixed toner-transferred recording paper was carried out in the fixing device, with the result being that good quality fixing having the fixing ratio of 80% or more (tape test) was carried out at 20 to 30 seconds after the start of the operation. Although the curie point of the PTC heater used in this fixing device was 190 degrees, another example shows that to obtain good fixing after 10 minutes from the start of the operation, the curie point should be set as 200 degrees.

The endless metal belt used in the present example was 20 micrometers thick for the Ni belt and 10 micrometers thick on the PTFE layer on the Ni belt. Although only black toner was evaluated in these fixing experiments, offset did not occur in any cases. The fixing rate was 40 mm/s.

Embodiment 2

Figure 7:
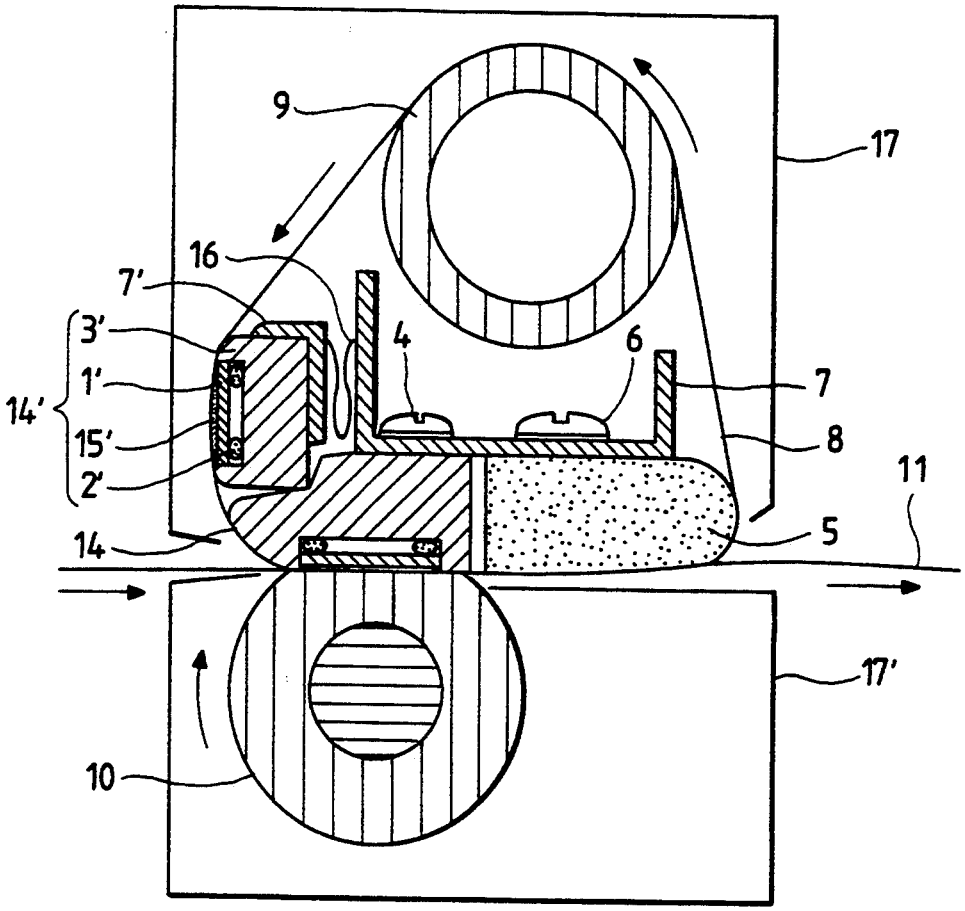
FIG. 7 is a cross-sectional view of a thermal fixing device according to another embodiment of the invention.
Figure 8A:
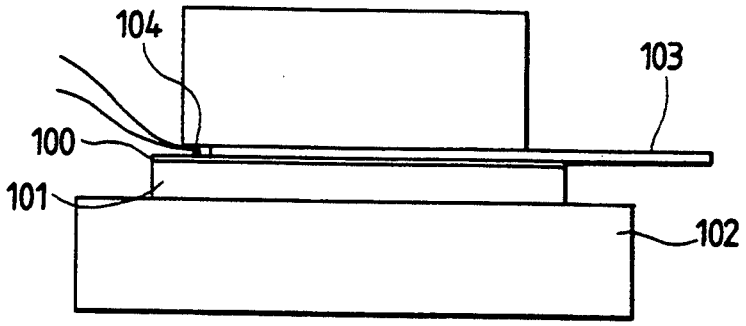
FIG. 8(a) PRIOR ART
FIGS. 8*a*, 8*b* and 8*c* are cross-sectional views illustrating a conventional non-offset evaluation method.
Figure 8B:
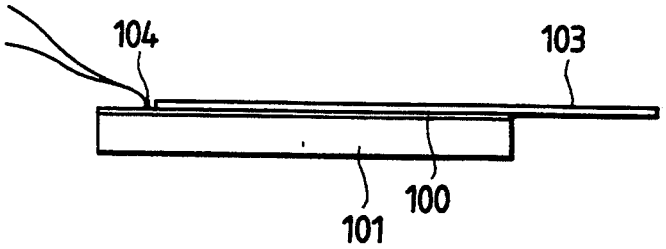
FIG. 8(b) PRIOR ART
Figure 8C:
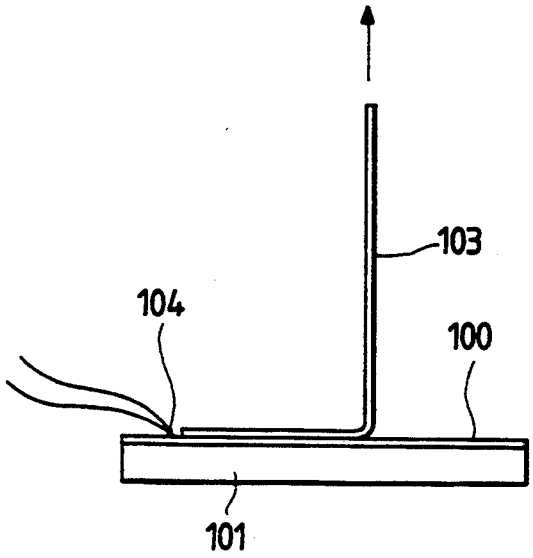
FIG. 8(c) PRIOR ART

FIG. 7 is a cross-sectional view of a thermal fixing device of a second embodiment of the present invention. This embodiment has a purpose of improving the heating ability and the prevention of occurrence of wrinkles in the endless metal belt 8, with an improvement in the fixing rate being attained by providing an additional preheater 14'.

The winding of the metal belt 8 on the drive roller 9 with a constant and low tension by pressing the preheater 14' against the endless metal belt 8 by the weak plate spring 16 led to a desired effect from the viewpoints of the prevention of slip for the metal belt 8 and the reduction of the rotation torque. Further, the number of parts can be reduced, and the man-hours for assembly are also reduced, one of the effects being that the preheater 14' can be secured by placing the two plates 16 into slits in the stays 7 and 7'. The other construction is the same as that of the first embodiment.

In the second embodiment, a fixing experiment was carried out using 150 degrees as the Curie point of the, PTC heater 1' of the preheater 14', 230 degrees as the Curie point of the PTC heater 1 of the main heater 14, and 100 mm/s as the fixing rate. A good fixing performance was obtained after 15 seconds from the operation start in a case where the same toner was used as in the first embodiment. Further, after 30 seconds from the operation start, a fixing rate of 20 to 25 sheets A4/minute could be obtained.

When a plurality of heaters were used, as in the above embodiment, about twice the rush electric power is required in a case where power is supplied to the PTC heaters at the same time. The time when the rush current is caused to flow is about 2 to 3 seconds. After the rush current, the usual current became ⅓ to 1/10 thereof. The use of this property leads to such large effects that when current is first supplied to the preheater 14; and after about 3 seconds when the current is supplied to the main heater 14, the maximum dissipation power is held to the increase of 20% with respect to the case of one heater and the delay of the start time for the fixing can be limited to 1 to 2 seconds. This is very advantageous.

Embodiment 3

Another experiment was evaluated using an endless metal belt 8 of a 20 micrometer thick endless Ni metal belt on the outer surface of which 3 to 5 micrometer thick silicone resin was covered. The remaining construction is the same as in the first embodiment.

Since the thickness of the non-adhesive film is thin in this fixing device (as much as ⅓ to ½ of the thickness in the first embodiment), a good thermal conduction ratio and a good fixing property after 10 seconds from the operation start were obtained. The toner used in this example was the same black toner as in the first and second embodiments, and offset did not occur.

When using a recording paper to which a magenta toner-contained color toner image is transferred and fixed in a fixing device, it was found that good quality fixing with no offset can be realized. The fixing rate of the usual paper is 40 mm/s. Nevertheless, it was also found that if the fixing rate in color OHP is decreased to 20 mm/s, good quality fixing can be realized. This is true since the heat capacity of the OHP sheet is larger than that of the usual paper, and more heat capacity for uniformly melting the toner is required.

Embodiment 4

In this embodiment, the fixing device of the second embodiment was produced using the same endless metal belt as used in the third embodiment, and an experiment was evaluated. The thermal efficiency was improved over that of the second and third embodiments. The fixing property of the color toner was the same as in the third embodiment.

According to the present invention, the dry fixing which could not be realized in a conventional thermal fixing device can now be carried out. Particularly, dry fixing to the color can for the first time, be realized. Further, the thermal efficiency is improved, and the warming up time is shortened to 10 to 15 seconds using half or less than half of the dissipation power of the conventional thermal fixing device.

What is claimed is:

1. A thermal fixing device comprising a pair of rotating rollers including a drive roller, a heating/cooling section associated with at least the drive roller, and an image supporter having an unfixed toner image which image supporter is passed through a gap between the rollers so that the unfixed toner image is thermally fixed by melting, the heating/cooling section having an integral structure type heating and cooling device comprising a supporter, a cooler and a heater, said cooler and said heater being secured to said supporter, said thermal fixing device further comprising a thin endless metal belt which rotates while contacting the integral structure type heating/cooling device and which belt has a non-adhesive film on an outer surface thereof which is in pressure-contact with the image supporter, said drive roller drives the endless metal belt for rotation while applying tension to the endless metal belt, wherein a surface temperature at a portion of the endless metal belt where said endless metal belt is in pressure-contact with the image supporter is first increased to a temperature (Tm) near the melting point of said toner and subsequently cooled so that the image supporter can be removed from pressure contact with the endless metal belt, and so that the temperature of the toner is higher than a glass transition point of the toner and lower than a softening point thereof, and further wherein said cooler is secured to the supporter at a rotation axis of said cooler so that said cooler can rotate about the rotation axis.

2. A thermal fixing device according to claim 1, wherein said drive roller comprises a material having a sufficiently large coefficient of friction on an outside surface of said drive roller, a significantly lower heat conductivity than a metal material of said metal belt and a significantly small heat capacity.

3. A thermal fixing device according to claim 1, wherein the non-adhesive film of said endless metal belt comprises a flat thin material of one of a silicone rubber and a silicone resin.

4. A thermal fixing device according to claim 1, wherein a rubber hardness of a press roller driven and rotated while being pressed and contacted against said integral structure type heating and cooling device is 30 degrees or less as measured on the ASKER C scale.

5. A thermal fixing device according to claim 1, wherein the pressure of a press roller is generated by an electromagnetic solenoid, and wherein the pressure of the press roller is released during non-operating times of the fixing device.

6. A thermal fixing device comprising a pair of rotating rollers including a drive roller, a heating/cooling section associated with at least the drive roller, and an image supporter having an unfixed toner image which image supporter is passed through a gap between the rollers so that the unfixed toner image is thermally fixed by melting, the heating/cooling section having an integral structure type heating and cooling device comprising a supporter, a cooler and a heater, said cooler and said heater being secured to said supporter, said thermal fixing device further comprising a thin endless metal belt which rotates while contacting the integral structure type heating/cooling device and which belt has a non-adhesive film on an outer surface thereof which is in pressure-contact with the image supporter, said drive roller drives the endless metal belt for rotation while applying tension to the endless metal belt, wherein a surface temperature at a portion of belt the endless metal where said endless metal belt is in pressure-contact with the image supporter is first increased to a temperature (Tm) near the melting point of said toner and subsequently cooled so that the image supporter can be removed from pressure contact with the endless metal belt, and so that the temperature of the toner is higher than a glass transition point of the toner and lower than a softening point thereof, and further wherein said heater has a plurality of heating sources secured to the supporter and said cooler is secured to the supporter at a rotation axis of said cooler so that said cooler can rotate about the rotation axis.

7. A thermal fixing device according to claim 6, wherein a start time for current supply to a heating source of said integral structure type heating and cooling device having a plurality of heating sources is successively shifted with respect to time.

* * * * *